US011642887B2

(12) United States Patent
Marra, III

(10) Patent No.: US 11,642,887 B2
(45) Date of Patent: May 9, 2023

(54) EJECTION HEAD HAVING OPTIMIZED FLUID EJECTION CHARACTERISTICS

(71) Applicant: Funai Electric Co., Ltd., Osaka (JP)

(72) Inventor: Michael A. Marra, III, Lexington, KY (US)

(73) Assignee: Funai Electric Co., Ltd.

( * ) Notice: Subject to any disclaimer, the term of this patent is extended or adjusted under 35 U.S.C. 154(b) by 0 days.

(21) Appl. No.: 17/237,312

(22) Filed: Apr. 22, 2021

(65) Prior Publication Data

US 2022/0339933 A1 Oct. 27, 2022

(51) Int. Cl.
*B41J 2/14* (2006.01)
*B41J 2/16* (2006.01)

(52) U.S. Cl.
CPC ..... *B41J 2/1433* (2013.01); *B41J 2/162* (2013.01); *B41J 2/1631* (2013.01); *B41J 2002/14475* (2013.01)

(58) Field of Classification Search
CPC ..... B41J 2/1433; B41J 2/162; B41J 2/1631
See application file for complete search history.

(56) References Cited

U.S. PATENT DOCUMENTS 5,811,019 A 9/1998 Nakayama et al.
6,137,502 A 10/2000 Anderson et al.
6,142,607 A 11/2000 Takata et al.
7,014,297 B2 3/2006 Miki et al.
7,036,909 B2 5/2006 Kubota et al.
7,198,353 B2 4/2007 Hart et al.
7,384,130 B2 6/2008 Kubota et al.
7,448,710 B2 11/2008 Kusunoki
7,909,428 B2 3/2011 Donaldson et al.
8,007,079 B2 8/2011 Takahashi
8,684,498 B2 4/2014 Kuwata
9,022,526 B2 5/2015 Nakao
9,227,403 B2 1/2016 Yokoyama et al.
9,969,166 B2 5/2018 Suzuki
10,252,526 B2 4/2019 Tamai
2007/0296767 A1* 12/2007 Anderson ..... B41J 2/14072 347/62
2008/0024574 A1* 1/2008 Donaldson ..... B41J 2/1628 347/88
2013/0021405 A1* 1/2013 Fang ..... B41J 2/1639 216/2
2017/0157940 A1* 6/2017 Maxfield ..... B41J 2/1433
2019/0118533 A1 4/2019 Suzuki et al.

* cited by examiner

*Primary Examiner* — Jason S Uhlenhake
(74) *Attorney, Agent, or Firm* — Luedeka Neely Group, Inc.

(57) ABSTRACT

An ejection head. The ejection head includes first fluid ejectors and second fluid ejectors deposited on a semiconductor substrate. A first flow feature layer is attached to the semiconductor substrate to provide a first fluid supply channels and a first fluid chambers and a first portion of second fluid channel and second fluid chambers therein. A second flow feature layer is attached to the first flow feature layer to provide a first portion of first nozzle holes and a second portion of second fluid supply channels and second fluid chambers therein. A first nozzle plate layer is attached to the second flow feature layer to provide a second portion of the first nozzle holes and a first portion of second nozzle holes therein. A second nozzle plate layer is attached to the first nozzle plate layer to provide a second portion of the second nozzle holes therein.

17 Claims, 7 Drawing Sheets

EJECTION HEAD HAVING OPTIMIZED FLUID EJECTION CHARACTERISTICS

TECHNICAL FIELD

The disclosure relates to improved fluid ejection heads and in particular to methods for fabricating an ejection head having optimized fluid ejection characteristics for ejecting different fluids from the same ejection head.

BACKGROUND AND SUMMARY

Micro-electromechanical systems ("MEMS") and nano-devices typically include three-dimensional ("3D") structures made from photoimaged materials. Examples of MEMS and nano-devices include, but are not limited to fluid ejection heads, micro-filters, micro-separators, micro-sieves, and other micro and nano scale fluid handling structures. Such structures may handle a wide variety of fluids. For example, fluid ejection heads are nano devices that are useful for ejecting a variety of fluids including inks, cooling fluids, pharmaceuticals, lubricants, and the like. Fluid ejection heads may also be used in vaporization devices for vapor therapy, E-cigarettes, and the like.

The fluid ejection head is a seemingly simple device that has a relatively complicated structure containing electrical circuits, ink passageways and a variety of tiny parts assembled with precision to provide a powerful, yet versatile fluid ejection head. The components of the ejection head must cooperate with each other and be useful for a variety of fluids and fluid formulations. Accordingly, it is important to match the ejection head components to the fluid being ejected.

The primary components of a fluid ejection head are a semiconductor substrate, a flow feature layer, a nozzle plate layer, and a flexible circuit attached to the substrate. The semiconductor substrate is preferably made of silicon and contains various passivation layers, conductive metal layers, resistive layers, insulative layers and protective layers deposited on a device surface thereof. Fluid ejection actuators formed on a device surface of the substrate may be thermal actuators, bubble jet actuators, or piezoelectric actuators. For thermal actuators, individual heater resistors are defined in the resistive layers and each heater resistor corresponds to a nozzle hole in the nozzle plate for heating and ejecting fluid from the ejection head toward a desired substrate or target.

Conventional ejection heads contain a single flow feature layer and a single nozzle plate layer. Such an ejection head is typically designed and optimized for ejecting one type of fluid, for example inks, wherein a volume of black ink ejected may be less than 2 times a volume of color ink ejected by the ejection head. Thus, a single ejection head may be used for a fluid cartridge containing black and color inks.

In some applications, such as vapor therapy, pharmaceutical drug delivery, or assay analysis, a variety of aqueous and non-aqueous fluids and/or a variety of fluid volumes may be required to be ejected by a single ejection head attached to a multi-fluid containing cartridge. Hence, if it is desirable to eject two or more different types of fluids from a single ejection head, the ejection head that is optimized for ejecting one type of fluid may not be optimal for ejecting different types and/or volumes of fluids. For example, an ejection head designed for ejecting aqueous fluids will not be optimally designed for ejecting both aqueous and non-aqueous fluids. Likewise, an ejection head designed to eject from about 3 to about 6 nanograms of fluid may not be useful for ejecting two or more different fluids having fluid volume ratios ranging from about 2:1 to about 6:1.

Accordingly, what is needed is an ejection head that may be configured during the manufacturing process to provide optimal fluid ejection characteristics for two or more different types of fluids.

In view of the foregoing, an embodiment of the disclosure provides an ejection head for a fluid ejection device. The ejection head includes a plurality of first fluid ejectors and a plurality of second fluid ejectors deposited on a semiconductor substrate. A first flow feature layer is attached to the semiconductor substrate to provide a plurality of first fluid supply channels and a plurality of first fluid chambers in the first flow feature layer for the plurality of first fluid ejectors and a first portion of second fluid channel and second fluid chambers for the plurality of second fluid ejectors. A second flow feature layer is attached to the first flow feature layer to provide a first portion of first nozzle holes therein adjacent to the plurality of first fluid chambers and a second portion of second fluid supply channels and second fluid chambers therein for the plurality of second fluid ejectors. A first nozzle plate layer is attached to the second flow feature layer to provide a second portion of the first nozzle holes therein adjacent to the plurality of first fluid chambers and a first portion of second nozzle holes therein adjacent to the plurality of second fluid chambers. A second nozzle plate layer is attached to the first nozzle plate layer to provide a second portion of the second nozzle holes therein adjacent to the plurality of second fluid chambers. A volume of fluid ejected by the plurality of second fluid ejectors through the plurality of second nozzle holes is from about 2 to about 6 times greater than the volume of fluid ejected by the plurality of first fluid ejector through the plurality of first nozzle holes.

In another embodiment, there is provided a method of making an ejection head. The method includes providing a semiconductor substrate having a plurality of fluid ejectors thereon. A first fluid flow layer is applied to the semiconductor substrate. First fluid channels and first fluid chambers for a plurality of first fluid ejectors and a portion of second fluid channels and second fluid chambers therein for a plurality of second fluid ejectors are imaged and developed in the first fluid flow layer. A fluid supply via is etched through the semiconductor substrate. A second fluid flow layer is applied to the first fluid flow layer. A first portion of first nozzle holes therein adjacent to the first fluid chambers and a second portion of the second fluid channels and the second fluid chambers in the second fluid flow layer for the plurality of second fluid ejectors are imaged and developed in the second fluid flow layer. A first nozzle plate layer is applied to the second fluid flow layer. The first nozzle plate layer is imaged and developed to provide a second portion of the first nozzle holes therein adjacent to the fluid chambers and a first portion of second nozzle holes therein adjacent to the second fluid chambers. A second nozzle plate layer is applied to the first nozzle plate layer. The second nozzle plate layer is imaged and developed to provide a second portion of the second nozzle holes therein adjacent to the second fluid chambers. A volume of fluid ejected by the plurality of second fluid ejectors through the plurality of second nozzle holes is from about 2 to about 6 times greater than the volume of fluid ejected by the plurality of first fluid ejector through the plurality of first nozzle holes.

Another embodiment provides an ejection head that includes a semiconductor substrate containing a first plurality of fluid ejectors and a second plurality of fluid ejectors thereon, a flow feature layer attached to the semiconductor substrate, and a nozzle plate attached to the flow feature layer. The flow feature layer includes a first plurality of fluid supply channels and a first plurality of fluid chambers associated with the first plurality of fluid ejectors, and a second plurality of fluid supply channels and a second plurality of fluid chambers associated with the second plurality of fluid ejectors. The nozzle plate layer includes a first plurality of nozzle holes associated with the first plurality of fluid chambers and a second plurality of nozzle holes associated with the second plurality of fluid chambers. A volume of fluid ejected by the second plurality of nozzle holes is from about 2 to about 6 times greater than the volume of fluid ejected by the first plurality of first nozzle holes.

In some embodiments, the first flow feature layer is derived from a first photoresist material layer having a thickness ranging from about 10 to about 20 microns.

In some embodiments, the second flow feature layer is derived from a second photoresist material layer having a thickness ranging from about 1 to about 10 microns.

In some embodiments, the first nozzle plate layer is derived from a third photoresist material layer having a thickness ranging from about 5 to about 30 microns.

In some embodiments, the second nozzle plate layer is derived from a fourth photoresist material layer having a thickness ranging from about 5 to about 30 microns.

In some embodiments, the second flow feature layer, the first nozzle plate layer and the second nozzle plate layer comprise laminated photoresist material layers.

In some embodiments, the first fluid flow layer is a photoresist material that is spun on to the semiconductor substrate.

In some embodiments, the second fluid flow layer is laminated to the first fluid flow layer.

In some embodiments, the first nozzle plate layer is laminated to the second fluid flow layer.

In some embodiments, the second nozzle plate layer is laminated to the first nozzle plate layer.

In some embodiments, the flow feature layer comprises a first flow feature layer derived from a photoresist material attached to the semiconductor substrate and a second flow feature layer derived from a photoresist material attached to the first flow feature layer.

In some embodiments, the nozzle plate layer comprises a first nozzle plate layer attached to the second flow feature layer and a second nozzle plate layer attached to the first nozzle plate layer.

In some embodiments, the ejection head is attached to a fluid cartridge for a fluid ejection device, wherein the fluid cartridge contains at least two different fluids.

An advantage of the disclosed embodiments is an improved ability of a single ejection head to handle widely divergent fluids and/or widely divergent fluid volumes. The disclosed embodiments enable the manufacture of an ejection head having multiple optimal fluid ejection geometries including multiple thicknesses for both the flow feature layer and the nozzle plate layer of the ejection head. Accordingly, areas of an ejection head may be optimized individually for a particular fluid.

DETAILED DESCRIPTION

Figure 1:
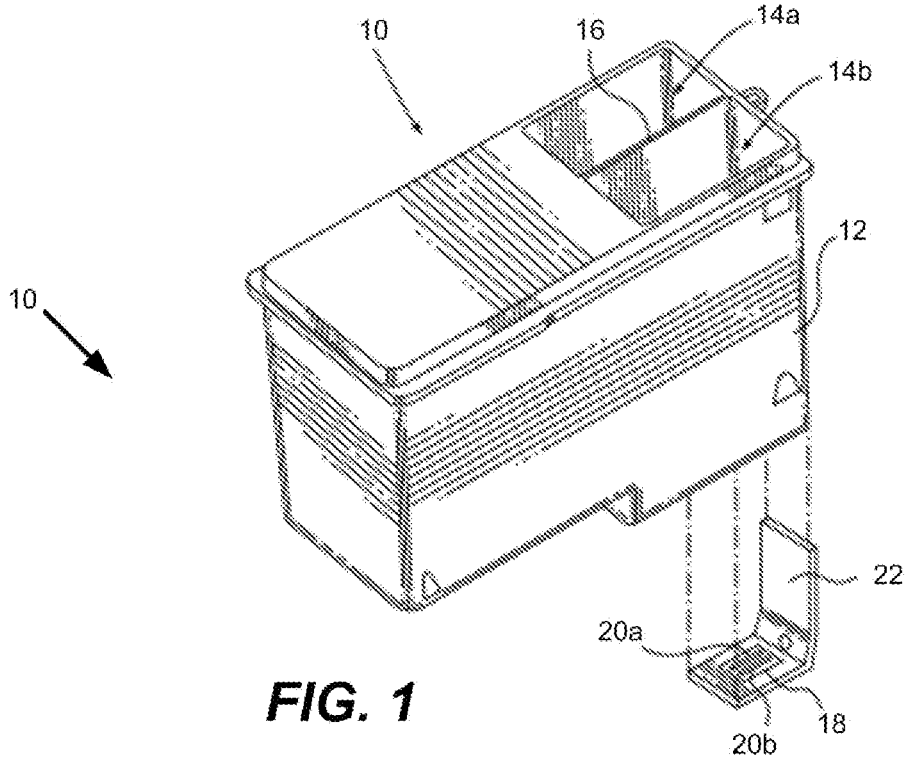
FIG. 1 is a perspective view, not to scale, of a fluid cartridge for ejecting up to two different fluids from a single ejection head.

With reference to FIG. 1 there is illustrated a fluid cartridge 12 having a cartridge body 12 containing fluid supply chambers 14*a* and 14*b* for dispensing up to two different fluids, and a dividing wall 16 between the fluid supply chambers 14*a* and 14*b*. An ejection head 18 containing two fluid supply vias 20*a* and 20*b* corresponding to fluid chambers 14*a* and 14*b* is attached by means of a flexible circuit 22 to the fluid cartridge 10. The flexible circuit provides electrical connection to a fluid ejection device to activate the fluid ejectors on the ejection head 18.

Figure 2:
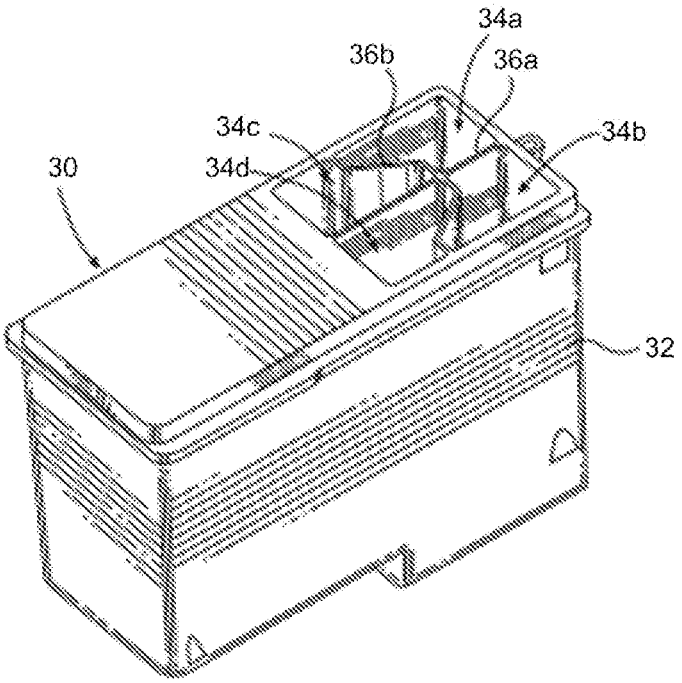
FIG. 2 is a perspective view, not to scale, of a fluid cartridge for ejecting up to four different fluids from a single ejection head.

FIG. 2 illustrates a fluid cartridge 30 having a cartridge body 32 containing fluid supply chambers 34*a*, 34*b*, 34*c*, and 34*d* for dispensing up to four different fluids, and dividing walls 36*a* and 36*b* between the fluid supply chambers 34*a*, 34*b*, 34*c* and 34*d*. An ejection head containing four fluid supply vias corresponding to fluid chambers 34*a*, 34*b*, 34*c*, and 34*d* is attached as described above to the fluid cartridge 30.

Figure 3:
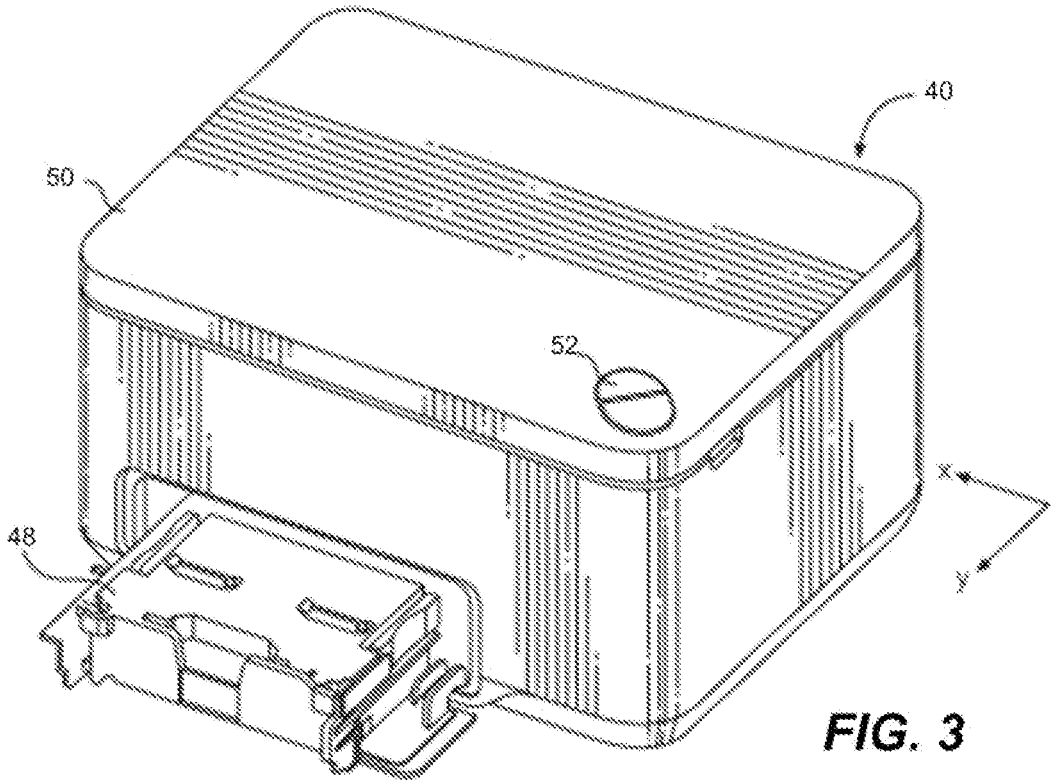
FIG. 3 is a perspective view, not to scale, of a fluid dispense device using the fluid cartridges of FIG. 1 or FIG. 2.
Figure 4:
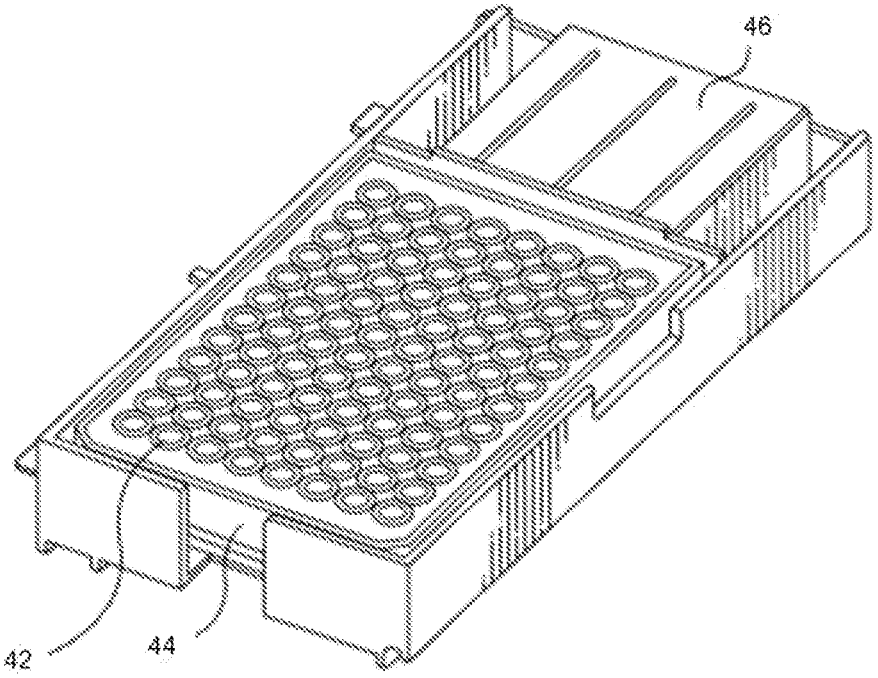
FIG. 4 is a perspective view, not to scale, of a micro-well plate and tray therefor for use with the fluid ejection device of FIG. 3.

The fluid cartridges 10 and 30 described above may be used for dispensing a wide variety of fluids including, but not limited to, inks, lubricants, medical assay fluids, pharmaceuticals, vapor therapy fluids, chemically reactive fluids, and the like. Such fluid cartridges 10 and 30 may be used, for example, in a fluid dispense device 40 (FIG. 3) for dispensing one or more fluids and/or one or more volumes of fluids into wells 42 of a micro-well plate 44 (FIG. 4) or onto glass slides (not shown). The micro-well plate 44 is typically held in a tray 46 that is placed into a carriage mechanism 48 for moving the micro-well plate 44 through the body 50 of the fluid dispense device 40 for depositing fluids in the wells 42 of the micro-well plate 44 when an activation button 52 for the device is depressed. For medical assay analysis, different wells 42 of the micro-well plate 44 may require different fluids and different amounts of the fluids to be dispensed from a single fluid cartridge in order to complete the analysis. The fluid cartridge used in the device 40 moves across the micro-well plate 44 in the x direction as the micro-well plate 44 moves through the device 40 in the y direction. Accordingly, a single fluid cartridge containing multiple fluid supply chambers may be used to dispense multiple fluids into the wells 42 of the micro-well plate 44.

Figure 5:
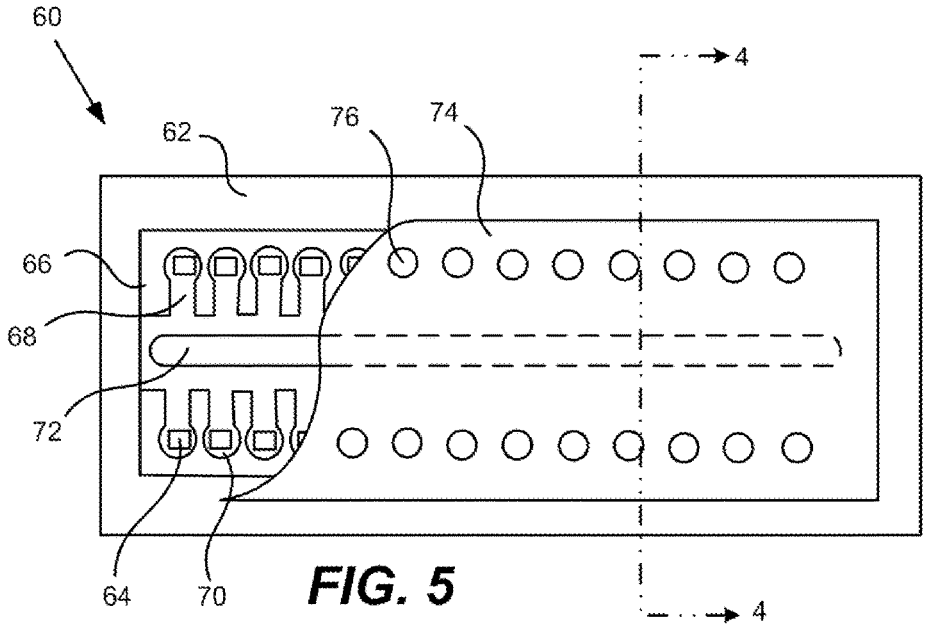
FIG. 5 PRIOR ART
FIG. 5 is a plan view, not to scale, of a portion of a prior art ejection head for ejecting a single fluid therefrom.
Figure 6:
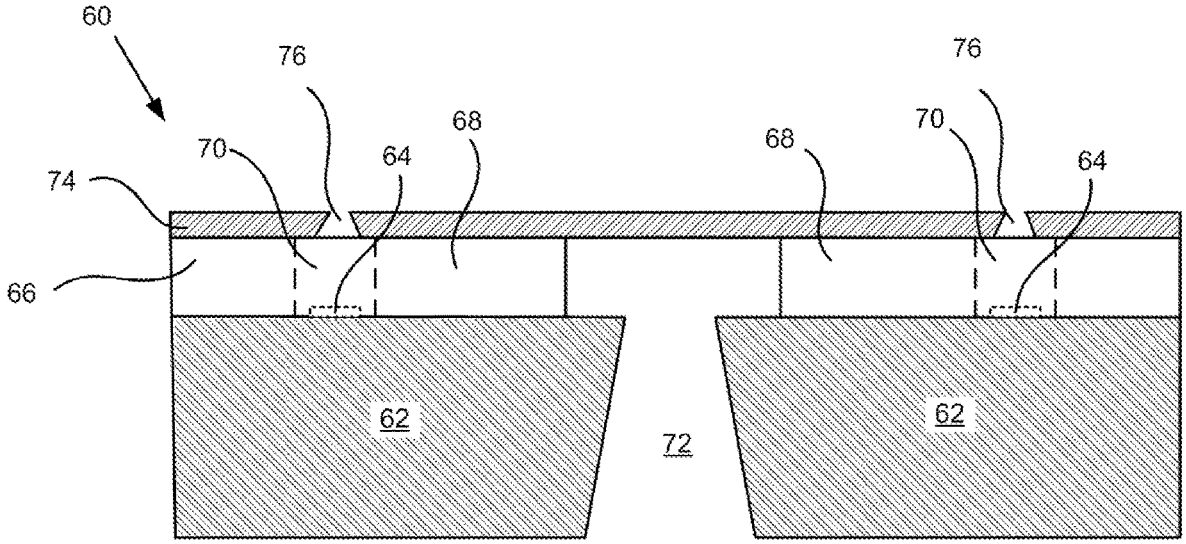
FIG. 6 PRIOR ART
FIG. 6 is a cross-sectional view, not to scale, of the prior art ejection head of FIG. 5.

As described above, a conventional prior art ejection head is typically optimized for a particular type of fluid. A plan view of a prior art ejection head 60 is illustrated in FIGS. 5 and 6. The ejection head 60 includes a semiconductor substrate 62 having a plurality of fluid ejector 64 and electrical circuits therefor, deposited thereon. The semiconductor substrate 62 is preferably a silicon semiconductor substrate 62 containing a plurality of fluid ejectors 64 such as piezoelectric devices or heater resistors formed thereon.

A fluid flow layer 66 containing fluid supply channels 68 and fluid chambers 70 is attached to the semiconductor substrate 62 to provide fluid from a fluid supply via 72 in the semiconductor substrate 62 through the fluid channels 68 to the fluid chambers 70. A nozzle plate 74 containing nozzle holes 76 is attached to the fluid flow layer 66. Upon activation of the fluid ejectors 64, fluid is ejected through the nozzle holes 76 in the nozzle plate 74 to a predetermined substrate or target material. The semiconductor substrate 12 is preferably a silicon semiconductor substrate 12 containing a plurality of fluid ejectors 14 such as piezoelectric devices or heater resistors formed on a device side of the substrate 12.

The foregoing prior art ejection head 60 can easily accommodate a single fluid wherein the volume and properties of the fluid remain relatively constant. By relatively constant, means the fluid has similar properties such as specific gravity, the fluid is either aqueous or non-aqueous, and the volume range of fluid ejected is less than a 2:1 volume ratio.

Figure 7:
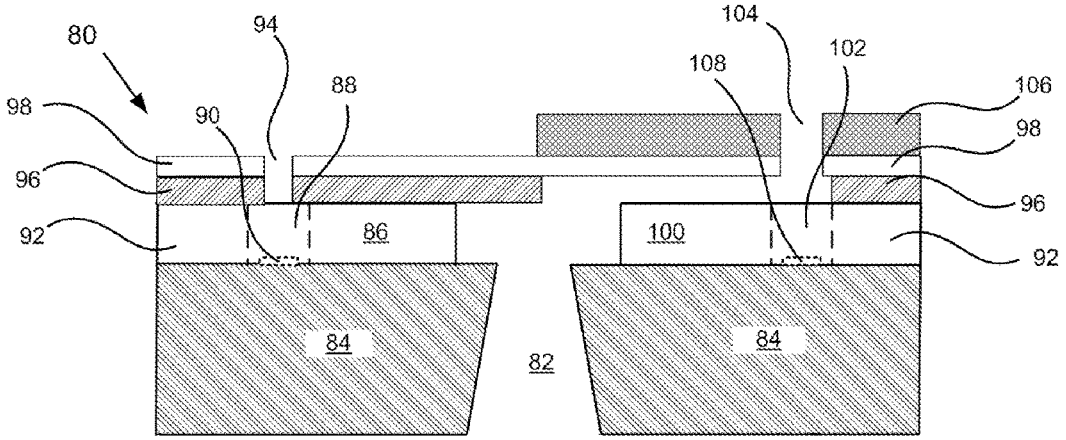
FIG. 7 is a cross-sectional view, not to scale, of an ejection head according to a first embodiment of the disclosure.
Figure 8:
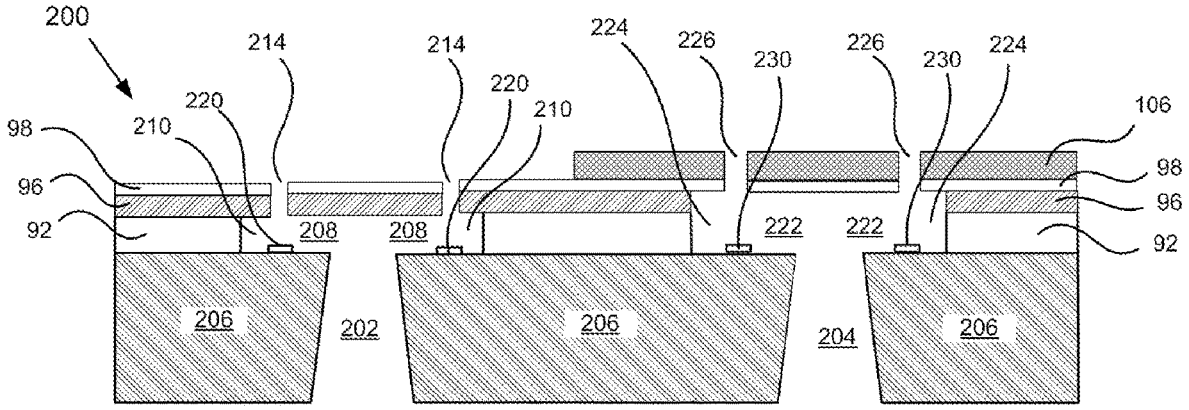
FIG. 8 is a cross-sectional view, not to scale, of an ejection head according to a second embodiment of the disclosure.

Nevertheless, ejection heads as illustrated in FIGS. 7 and 8 may be provided where there is a need to provide the ejection of fluid from a single ejection head wherein the properties of the fluid and amount of fluid ejected may vary widely. The ejection head 80 includes two distinct fluid flow geometries on opposing sides of a fluid supply via 82 that is etched through the semiconductor substrate 84. For example, the fluid flow channel 86 and fluid chamber 88 for the fluid ejector 90 are provided in a first flow feature layer 92 on the substrate 84 and the nozzle hole 94 is provided by a second flow feature layer 96 and a first nozzle plate layer 98. The first flow feature layer 92 may have a thickness ranging from about 10 to about 20 microns. The second flow feature layer 96 may have a thickness ranging from about 1-10 microns. The first nozzle plate layer 98 may have a thickness ranging from about 5-30 microns.

The opposing side of the fluid supply via 82 includes an enlarged fluid flow channel 100 and fluid chamber 102 provided by the first flow feature layer 92 and the second flow feature layer 96. Unlike the nozzle hole 94, the nozzle hole 104 is provided by the first nozzle plate layer 98 and a second nozzle plate layer 106. The second nozzle plate layer 106 may have a thickness ranging from about 5 to 30 microns. Depending on the thickness of the layers, 92, 96, 98, and 106, various fluidic volumes can be ejected from each side of the fluid supply vial 82. The ejection head 80 will enable the use of two different types of fluids such as water-based fluid and a solvent based fluid such as dimethyl sulfoxide (DMSO) and a volume of fluid ejected through nozzle hole 104 that is about 2 to about 6 times greater than a volume of fluid ejected through nozzle hole 94. For example, ejectors 90 may be activated when the desired volume of fluid to be ejected is low and ejectors 108 may be activated when the desired volume of fluid to be ejected is high. Likewise, ejectors 90 may be used for one type of fluid to be ejected and ejectors 108 may be used or a different type of fluid to be ejected. Thus, a single ejection head may be used for ejecting a wide variety and volumes of fluids using flow features and nozzles that are optimal for ejecting the particular fluid.

FIG. 8 illustrates a multi-via ejection head 200 for a cartridge having multiple fluid supply chambers for different fluids as described above with reference to FIGS. 1 and 2. For simplicity, only two fluid supply vias 202 and 204 etched through a semiconductor substrate 206 are illustrated. As with ejection head 80, ejection head 200 has fluid supply channels 208 and fluid chambers 210, provided in a first flow feature layer 92. The nozzle holes 214 are provided by a second flow feature layer 96 and a first nozzle plate layer 98. Accordingly, activation of ejectors 220 will provide ejection of fluid through nozzle holes 214. As described above, the first flow feature layer 92 may have a thickness ranging from about 10 to about 20 microns. The second flow feature layer 96 may have a thickness ranging from about 1 to about 10 microns. The first nozzle plate layer 98 may have a thickness ranging from about 5 to about 30 microns.

The ejection head 200 also includes flow features associated with fluid supply via 204 that are optimized for ejecting a greater volume of fluid than the fluid ejected by activating ejectors 220. Accordingly, the ejection head 200 also includes fluid supply channels 222 and fluid chambers that are provided by the first flow feature layer 92 and the second flow feature layer 96, and nozzle holes 226 that are provided by first nozzle plate layer 98 and a second nozzle plate layer 106. The second nozzle plate layer 106 has a thickness ranging from about 5 to about 30 microns. Upon activation of ejectors 230, a larger volume of fluid will be ejected through nozzle holes 226 compared to the volume of fluid ejected by nozzle holes 214.

In some embodiments, the first flow feature layer 92 may range from about 12 to about 16 microns in thickness and the second flow feature layer 96 may range from about 2 to about 9 microns in thickness. The first nozzle plate layer 98 may range from about 5 to about 12 microns in thickness and the second nozzle plate layer 106 may range from about 5 to about 20 microns in thickness. Other thicknesses may be used for the flow feature layers and nozzle plate layers depending on the particular flow characteristics required by the fluids being ejected.

Figure 9:
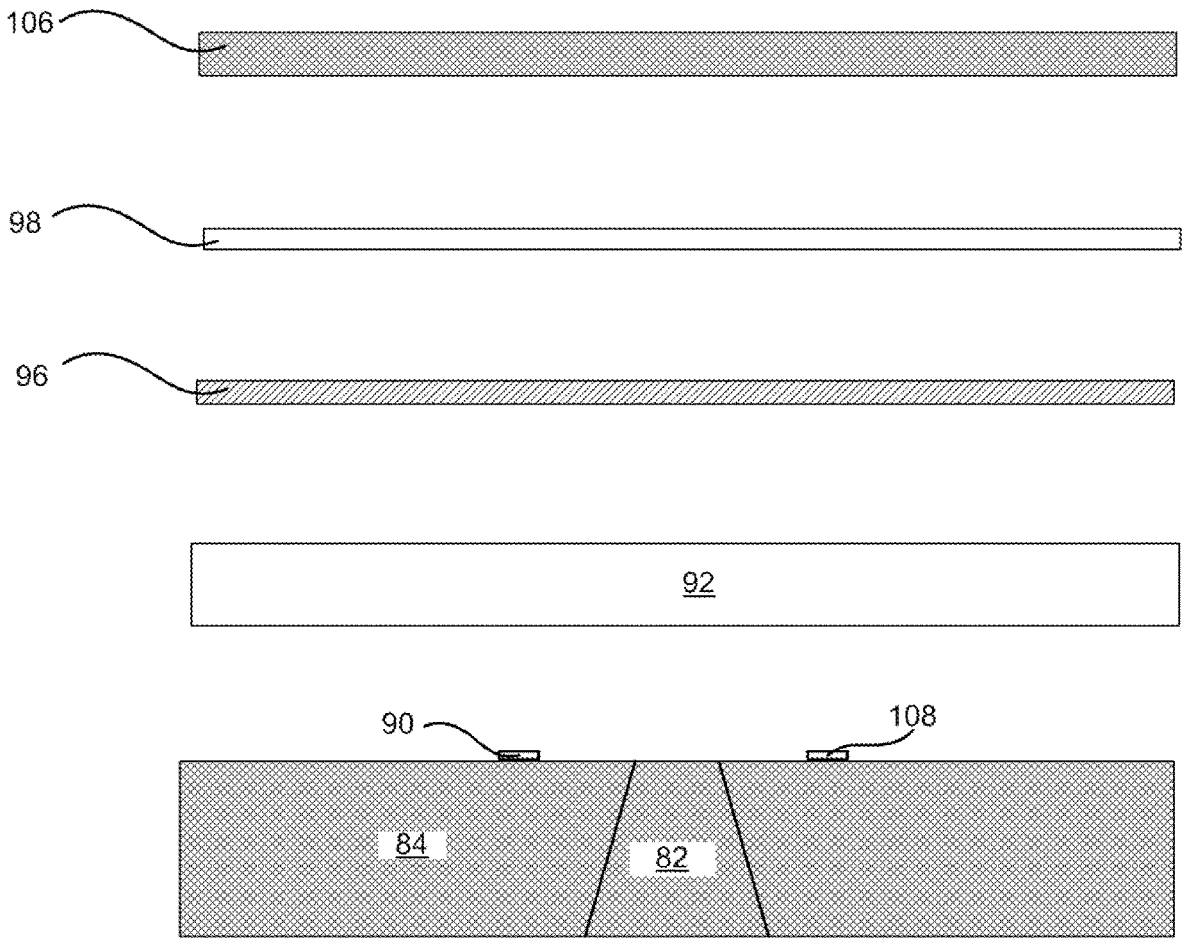
FIG. 9 is a schematic, cross-sectional view, not to scale of the application of photoimageable layers to a substrate and to one another to make an ejection head according to the disclosure.
Figure 10:
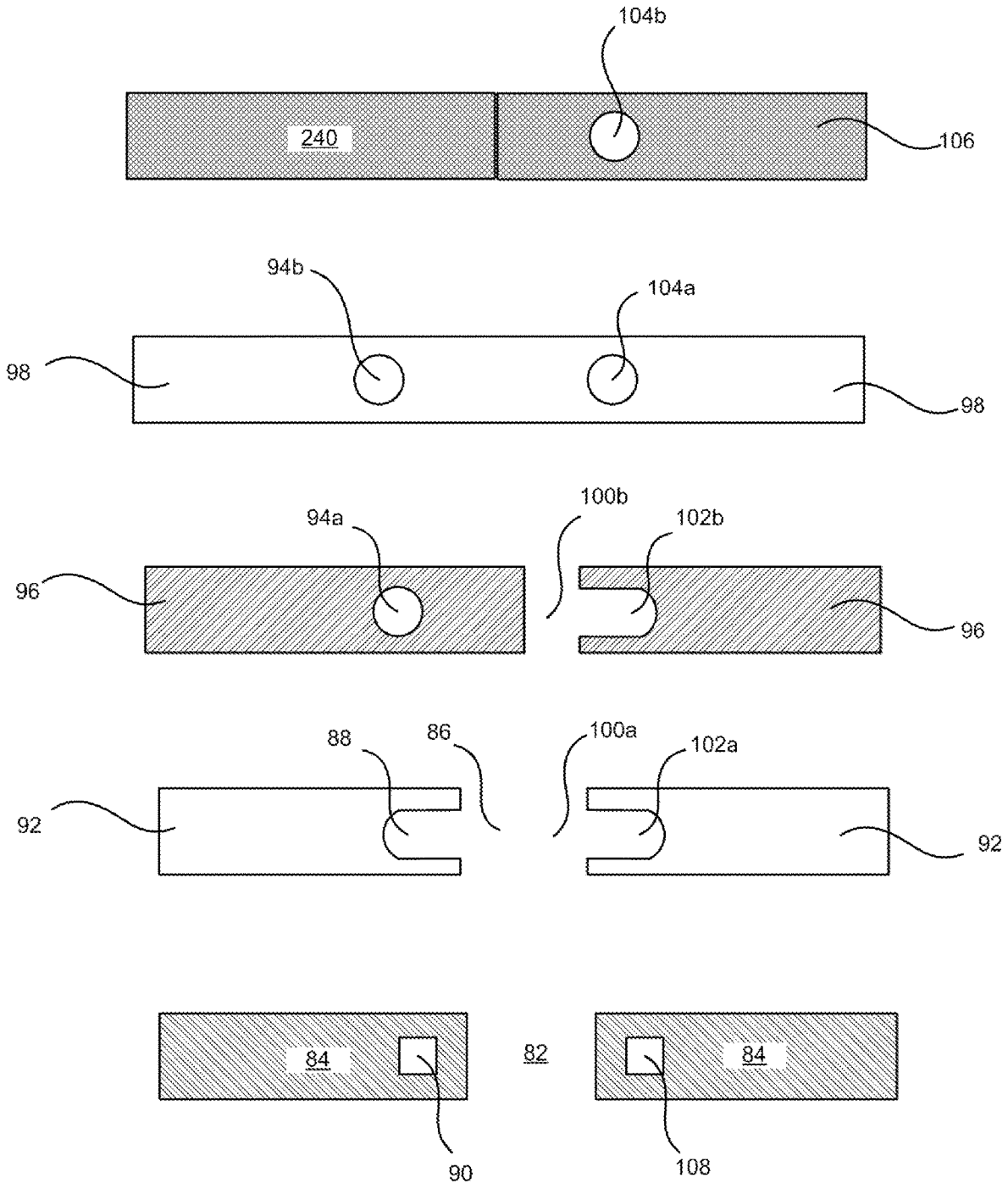
FIG. 10 is a plan view, not to scale, of a portion of a semiconductor substrate and photoimageable layers showing image and development patterns for each of the photoimageable layers for the ejection head of FIG. 7.

The ejection heads 80 may be made by applying a photoimageable material to the semiconductor substrate 84 by spin-coating or laminating the photoimageable material to the substrate 84. The photoimageable material may be a negative photoresist material, that is spin coated or laminated to the semiconductor substrate 84 prior to forming a fluid supply vias in the semiconductor substrate. With reference to FIGS. 9 and 10 in combination with FIG. 7, the imaging and developing pattern for each layer used to provide the ejection head 80 is illustrated. Each of the layers 92, 96, 98 and 106 are applied one at a time to the ejection head structure. The layers are then imaged and developed one at a time in using the pattern shown in FIG. 10 for each layer.

As shown, the semiconductor substrate 84 includes the fluid ejectors 90 and 108 formed thereon by conventional micro-electronic processing techniques. Next, the first flow feature layer 92 is spun-on to or laminated to the semiconductor substrate 84. The first flow feature layer 92 is then imaged through a mask and developed to provide fluid flow channel 86 and a first portion of fluid flow channel 100*a* therein, as well as fluid chamber 88 and a first portion of fluid chamber 102*a*. After imaging and developing the first fluid flow layer 92, the fluid supply via 82 is etched through the semiconductor substrate using a deep reactive ion etch (DRIE) process.

Next, the second flow feature layer 96 is laminated to the imaged and developed first flow feature layer 92. The second flow feature layer 96 is imaged through a mask and developed to provide a first portion of nozzle hole 94*a* and a second portion of the fluid flow channel 100*b* and a second portion of fluid chamber 102*b* therein.

Next, the first nozzle plate layer is laminated to the second flow feature layer 96. The first nozzle plate layer 98 is imaged through a mask and developed to provide a second portion of nozzle hole 94*b* and a first portion of nozzle hole 104*a*. After imaging and developing the first nozzle plate layer 98, the second nozzle plate layer 106 is laminated to the first nozzle plate layer 98. The second nozzle plate layer 106 is imaged through a mask and developed to completely remove portion 240 and to form a second portion of nozzle hole 104*b* therein. When a negative photoresist material is used to form the ejection head, only the areas exposed to actinic radiation remain and the unexposed areas, blocked by opaque areas of the mask are removed forming the flow features of the ejection head in each layer as shown in FIG. 8.

Figure 11:
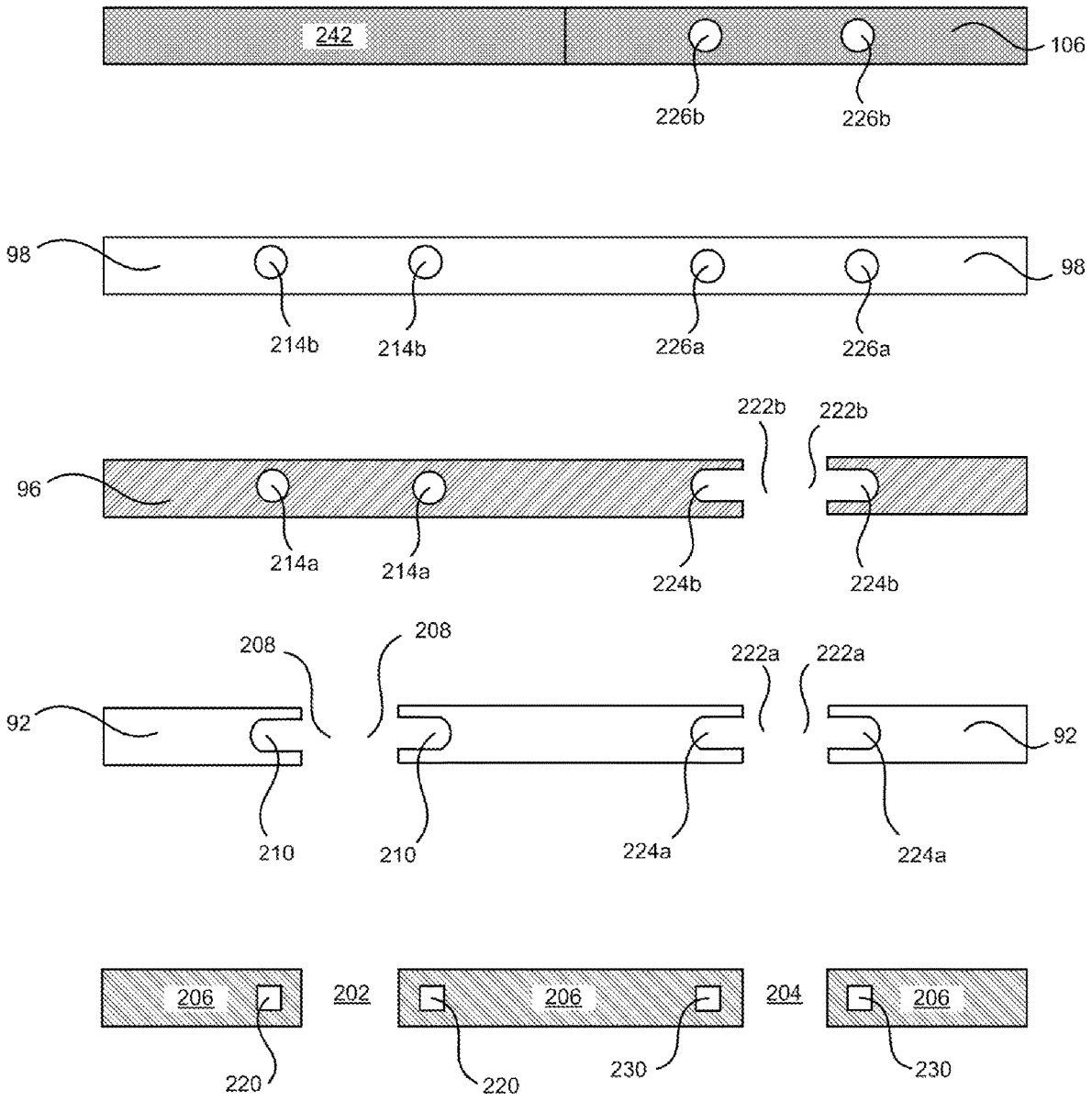
FIG. 11 is a plan view, not to scale, of a portion of a semiconductor substrate and photoimageable layers showing image and development patterns for each of the photoimageable layers for the ejection head of FIG. 8.

With reference to FIGS. 9 and 11 in combination with FIG. 8, the imaging and developing pattern for each layer used to provide the ejection head 200 is illustrated. Each of the layers 92, 96, 98 and 106 are applied one at a time to the ejection head structure. The layers are then imaged and developed one at a time in using the pattern shown in FIG. 11 for each layer.

As shown, the semiconductor substrate 206 includes the fluid ejectors 220 and 230 formed thereon by conventional micro-electronic processing techniques. Next, the first flow feature layer 92 is spun-on to or laminated to the semiconductor substrate 206. The first flow feature layer 92 is then imaged through a mask and developed to provide fluid flow channels 208 and a first portion of fluid flow channels 222*a* therein, as well as fluid chambers 210 and a first portion of fluid chambers 224*a*. After imaging and developing the first fluid flow layer 92, the fluid supply vias 202 and 204 is etched through the semiconductor substrate using a deep reactive ion etch (DRIE) process.

Next, the second flow feature layer 96 is laminated to the imaged and developed first flow feature layer 92. The second flow feature layer 96 is imaged through a mask and developed to provide a first portion of nozzle holes 214*a* and a second portion of the fluid flow channels 222*b* and fluid chambers 224*b* therein.

Next, the first nozzle plate layer is laminated to the second flow feature layer 96. The first nozzle plate layer 98 is imaged through a mask and developed to provide a second portion of nozzle holes 214*b* and a first portion of nozzle holes 226*a*. After imaging and developing the first nozzle plate layer 98, the second nozzle plate layer 106 is laminated to the first nozzle plate layer 98. The second nozzle plate layer 106 is imaged through a mask and developed to completely remove portion 242 and to form a second portion of nozzle holes 226*b* therein.

The photoresist materials that may be used for making the first and second flow feature layers 92 and 96 and the first and second nozzle plate layers 98 and 106 typically contain photoacid generators and may be formulated to include one or more of a multi-functional epoxy compound, a di-functional epoxy compound, a relatively high molecular weight polyhydroxy ether, an adhesion enhancer, an aliphatic ketone solvent, and optionally a hydrophobicity agent. For purposes of the disclosure, "difunctional epoxy" means epoxy compounds and materials having only two epoxy functional groups in the molecule. "Multifunctional epoxy" means epoxy compounds and materials having more than two epoxy functional groups in the molecule.

An epoxy component for making a photoresist formulation according to the disclosure, may be selected from aromatic epoxides such as glycidyl ethers of polyphenols. An exemplary first multi-functional epoxy resin is a polyglycidyl ether of a phenolformaldehyde novolac resin such as a novolac epoxy resin having an epoxide gram equivalent weight ranging from about 190 to about 250 and a viscosity at 130° C. ranging from about 10 to about 60.

The multi-functional epoxy component may have a weight average molecular weight of about 3,000 to about 5,000 Daltons as determined by gel permeation chromatography, and an average epoxide group functionality of greater than 3, preferably from about 6 to about 10. The amount of multifunctional epoxy resin in a photoresist formulation may range from about 30 to about 50 percent by weight based on the weight of the dried photoresist layer.

The di-functional epoxy component may be selected from di-functional epoxy compounds which include diglycidyl ethers of bisphenol-A, 3,4-epoxycyclohexylmethyl-3,4-epoxycyclo-hexene carboxylate, 3,4-epoxy-6-methylcyclohexylmethyl-3,4-epoxy-6-methylcyclohexene carboxylate, bis(3,4-epoxy-6-methylcyclohexylmethyl) adipate, and bis (2,3-epoxycyclopentyl) ether.

An exemplary di-functional epoxy component is a bisphenol-A/epichlorohydrin epoxy resin having an epoxide equivalent of greater than about 1000. An "epoxide equivalent" is the number of grams of resin containing 1 gram-equivalent of epoxide. The weight average molecular weight of the di-functional epoxy component is typically above 2500 Daltons, e.g., from about 2800 to about 3500 weight average molecular weight. The amount of the first di-functional epoxy component in a photoresist formulation may range from about 30 to about 50 percent by weight based on the weight of the cured resin.

Exemplary photoacid generators include compounds or mixture of compounds capable of generating a cation such as an aromatic complex salt which may be selected from onium salts of a Group VA element, onium salts of a Group VIA element, and aromatic halonium salts. Aromatic complex salts, upon being exposed to ultraviolet radiation or electron beam irradiation, are capable of generating acid moieties which initiate reactions with epoxides. The photoacid generator may be present in the photoresist formulations described herein in an amount ranging from about 5 to about 15 weight percent based on the weight of the cured resin.

Compounds that generate a protic acid when irradiated by active rays, may be used as the photoacid generator, including, but are not limited to, aromatic iodonium complex salts and aromatic sulfonium complex salts. Examples include di-(t-butylphenyl)iodonium triflate, diphenyliodonium tetrakis(pentafluorophenyl)borate, diphenyliodonium hexafluorophosphate, diphenyliodonium hexafluoroantimonate, di(4-nonylphenyl)iodonium hexafluorophosphate, [4-(octyloxy)phenyl]phenyliodonium hexafluoroantimonate, triphenylsulfonium triflate, triphenylsulfonium hexafluorophosphate, triphenylsulfonium hexafluoroantimonate, triphenylsulfonium tetrakis(pentafluorophenyl)borate, 4,4'-bis[diphenyl sulfonium]diphenylsulfide, bis-hexafluorophosphate, 4,4'-bis[di([beta]-hydroxyethoxy) phenyl sulfonium]diphenylsulfide bis-hexafluoroantimonate, 4,4'-bis[di([beta]-hydroxyethoxy) (phenyl sulfonium)diphenylsulfide-bishexafluoro-phosphate 7-[di(p-tolyl)sulfonium]-2-isopropylthioxanthone hexafluorophosphate, 7-[di(p-tolyl)sulfonio-2-isopropylthioxanthone hexafluoroantimonate, 7-[di(p-tolyl)sulfonium]-2-isopropyl tetrakis(pentafluorophenyl)borate, phenylcarbonyl-4'-diphenylsulfonium diphenylsulfide hexafluorophosphate, phenylcarbonyl-4'-diphenylsulfonium diphenylsulfide hexafluoroantimonate, 4-tert-butylphenylcarbonyl-4'-diphenylsulfonium diphenylsulfide hexafluorophosphate, 4-tert-butylphenylcarbonyl-4'-diphenylsulfonium diphenylsulfide hexafluoroantimonate, 4-tert-butylphenylcarbonyl-4'-diphenylsulfonium diphenylsulfide tetrakis(pentafluorophenyl) borate, diphenyl [4-(phenylthio)phenyl]sulfonium hexafluoroantimonate and the like.

A solvent for use in preparing photoresist formulations is a solvent which is non-photoreactive. Non-photoreactive solvents include, but are not limited gamma-butyrolactone, $C_{1-6}$ acetates, tetrahydrofuran, low molecular weight ketones, mixtures thereof and the like. The non-photoreactive solvent is present in the formulation mixture used to provide the nozzle plate layers 400 and 424 in an amount ranging from about 20 to about 90 weight percent, such as from about 40 to about 60 weight percent, based on the total weight of the photoresist formulation. The non-photoreactive solvent typically does not remain in the cured composite film layer and is thus removed prior to or during the composite film layer curing steps.

The photoresist formulation may optionally include an effective amount of an adhesion enhancing agent such as a silane compound. Silane compounds that are compatible with the components of the photoresist formulation typically have a functional group capable of reacting with at least one member selected from the group consisting of the multifunctional epoxy compound, the difunctional epoxy compound and the photoinitiator. Such an adhesion enhancing agent may be a silane with an epoxide functional group such as 3-(guanidinyl)propyltrimethoxysilane, and a glycidoxyalkyltrialkoxysilane, e.g., gamma-glycidoxypropyltrimethoxysilane. When used, the adhesion enhancing agent can be present in an amount ranging from about 0.5 to about 2 weight percent, such as from about 1.0 to about 1.5 weight percent based on total weight of the cured resin, including all ranges subsumed therein. Adhesion enhancing agents, as used herein, are defined to mean organic materials soluble in the photoresist composition which assist the film forming and adhesion characteristics of the photoresist materials.

Another optional component that may be used in the photoresist formulations for the nozzle plate layers includes a hydrophobicity agent. The hydrophobicity agent that may be used includes silicon containing materials such as silanes and siloxanes. Accordingly, the hydrophobicity agent may be selected from heptadecafluorodecyltrimethoxysilane, octadecyldimethylchlorosilane, ocatadecyltricholorsilane, methytrimethoxysilane, octyltriethoxysilane, phenyltrimethoxysilane, t-butylmethoxysilane, tetraethoxysilane, sodium methyl siliconate, vinytrimethoxysilane, N-(3-(trimethoxylsilyl)propyl)ethylenediamine polymethylmethoxysiloxane, polydimethylsiloxane, polyethylhydrogensiloxane, and dimethyl siloxane. The amount of hydrophobicity agent in the photoresist layers 400 and 424 may range from about 0.5 to about 2 weight percent, such as from about 1.0 to about 1.5 weight percent based on total weight of the cured resin, including all ranges subsumed therein.

While the foregoing disclosure provides nozzle plate layers 98 and 106 made of photoresist materials, the first and second nozzle plate layers are not limited to photoresist material layers. Other materials such as polyimide materials may be used to provide the first and second nozzle plate layers 98 and 106.

It is noted that, as used in this specification and the appended claims, the singular forms "a," "an," and "the," include plural referents unless expressly and unequivocally limited to one referent. As used herein, the term "include" and its grammatical variants are intended to be non-limiting, such that recitation of items in a list is not to the exclusion of other like items that can be substituted or added to the listed items.

For the purposes of this specification and appended claims, unless otherwise indicated, all numbers expressing quantities, percentages or proportions, and other numerical values used in the specification and claims, are to be understood as being modified in all instances by the term "about." Accordingly, unless indicated to the contrary, the numerical parameters set forth in the following specification and attached claims are approximations that can vary depending upon the desired properties sought to be obtained by the present disclosure. At the very least, and not as an attempt to limit the application of the doctrine of equivalents to the scope of the claims, each numerical parameter should at least be construed in light of the number of reported significant digits and by applying ordinary rounding techniques.

While particular embodiments have been described, alternatives, modifications, variations, improvements, and substantial equivalents that are or can be presently unforeseen can arise to applicants or others skilled in the art. Accordingly, the appended claims as filed and as they can be amended are intended to embrace all such alternatives, modifications variations, improvements, and substantial equivalents.

What is claimed is:

1. An ejection head for a fluid ejection device, the ejection head comprising:

a plurality of first fluid ejectors and a plurality of second fluid ejectors deposited on a semiconductor substrate;

a first flow feature layer attached to the semiconductor substrate providing a plurality of first fluid supply channels and a plurality of first fluid chambers in the first flow feature layer for the plurality of first fluid ejectors and a first portion of second fluid channel and second fluid chambers for the plurality of second fluid ejectors;

a second flow feature layer laminate laminated to the first flow feature layer providing a first portion of first nozzle holes therein adjacent to the plurality of first fluid chambers and a second portion of second fluid supply channels and second fluid chambers therein for the plurality of second fluid ejectors;

a first nozzle plate layer laminate laminated to the second flow feature layer providing a second portion of the first nozzle holes therein adjacent to the plurality of first fluid chambers and a first portion of second nozzle holes therein adjacent to the plurality of second fluid chambers; and a second nozzle plate layer laminate laminated to the first nozzle plate layer providing a second portion of the second nozzle holes therein adjacent to the plurality of second fluid chambers.

2. The ejection head of claim 1, wherein the second fluid ejectors and nozzle holes are configured to eject a volume of fluid that is from about 2 to about 6 times greater than the volume of fluid configured to be ejected by the plurality of first fluid ejectors through the first nozzle holes.

3. The ejection head of claim 1, wherein the first flow feature layer is derived from a first photoresist material layer having a thickness ranging from about 10 to about 20 microns.

4. The ejection head of claim 1, wherein the second flow feature layer laminate is derived from a second photoresist material layer having a thickness ranging from about 1 to about 10 microns.

5. The ejection head of claim 1, wherein the first nozzle plate layer laminate is derived from a third photoresist material layer having a thickness ranging from about 5 to about 30 microns.

6. The ejection head of claim 1, wherein the second nozzle plate laminate layer is derived from a fourth photoresist material layer having a thickness ranging from about 5 to about 30 microns.

7. The ejection head of claim 1, wherein the ejection head is attached to a fluid cartridge for a fluid ejection device, wherein the fluid cartridge contains at least two different fluids.

8. A method of making an ejection head, the method comprising:

providing a semiconductor substrate having a plurality of fluid ejectors thereon;

applying a first fluid flow layer to the semiconductor substrate;

imaging and developing first fluid channels and first fluid chambers in the first fluid flow layer for a plurality of first fluid ejectors and a portion of second fluid channels and second fluid chambers therein for a plurality of second fluid ejectors;

etching a fluid supply via through the semiconductor substrate;

laminating a second fluid flow layer laminate to the first fluid flow layer;

imagining and developing a first portion of first nozzle holes therein adjacent to the first fluid chambers and a second portion of the second fluid channels and the second fluid chambers in the second fluid flow layer laminate for the plurality of second fluid ejectors;

laminating a first nozzle plate layer laminate to the second fluid flow layer laminate;

imaging and developing the first nozzle plate layer laminate to provide a second portion of the first nozzle holes therein adjacent to the fluid chambers and a first portion of second nozzle holes therein adjacent to the second fluid chambers;

laminating a second nozzle plate layer laminate to the first nozzle plate layer laminate; and imaging and developing the second nozzle plate layer laminate to provide a second portion of the second nozzle holes therein adjacent to the second fluid chambers, wherein a volume of fluid ejected by the plurality of second fluid ejectors through the plurality of second nozzle holes is from about 2 to about 6 times greater than the volume of fluid ejected by the plurality of first fluid ejector through the plurality of first nozzle holes.

9. The method of claim 8, wherein the first fluid flow layer is a photoresist material that is spun on to the semiconductor substrate.

10. The method of claim 8, wherein the second fluid flow layer laminate is derived from a second photoresist material layer having a thickness ranging from about 1 to about 10 microns.

11. The method of claim 8, wherein the first nozzle plate layer laminate is derived from a third photoresist material layer having a thickness ranging from about 5 to about 30 microns.

12. The method of claim 8 wherein the second nozzle plate layer laminate is derived from a fourth photoresist material layer having a thickness ranging from about 5 to about 30 microns.

13. An ejection head comprising:

a semiconductor substrate containing a first plurality of fluid ejectors and a second plurality of fluid ejectors thereon, a flow feature layer attached to the semiconductor substrate, and a nozzle plate laminated to the flow feature layer, wherein the flow feature layer comprises:

a first plurality of fluid supply channels and a first plurality of fluid chambers associated with the first plurality of fluid ejectors, and a second plurality of fluid supply channels and a second plurality of fluid chambers associated with the second plurality of fluid ejectors, and wherein the flow feature layer comprises a first flow feature layer derived from a photoresist material attached to the semiconductor substrate and a second flow feature layer laminate derived from a photoresist material laminated to the first flow feature layer; and the nozzle plate layer comprises:

a first plurality of nozzle holes associated with the first plurality of fluid chambers and a second plurality of nozzle holes associated with the second plurality of fluid chambers, wherein the nozzle plate layer comprises a first nozzle plate layer laminate laminated to the second flow feature layer and a second nozzle plate layer laminate laminated to the first nozzle plate layer laminate; and wherein a volume of fluid ejected by the second plurality of nozzle holes is from about 2 to about 6 times greater than the volume of fluid ejected by the first plurality of first nozzle holes.

14. The multi-fluid ejection head of claim 13, wherein the first flow feature layer has a thickness ranging from about 10 to about 20 microns.

15. The multi-fluid ejection head of claim 13, wherein the second flow feature layer laminate has a thickness ranging from about 1 to about 10 microns.

16. The multi-fluid ejection head of claim 15, wherein the first nozzle plate layer laminate has a thickness ranging from about 5 to about 30 microns.

17. The multi-fluid ejection head of claim 15, wherein the second nozzle plate layer laminate has a thickness ranging from about 5 to about 30 microns.

* * * * *